US008522586B2

(12) United States Patent
Faderl

(10) Patent No.: US 8,522,586 B2
(45) Date of Patent: Sep. 3, 2013

(54) METHOD FOR FLEXIBLY ROLLING COATED STEEL STRIPS

(75) Inventor: Josef Faderl, Steyr (AT)

(73) Assignee: Voestalpine Stahl GmbH, Linz (AT)

( * ) Notice: Subject to any disclaimer, the term of this patent is extended or adjusted under 35 U.S.C. 154(b) by 668 days.

(21) Appl. No.: 12/532,118

(22) PCT Filed: Jan. 31, 2008

(86) PCT No.: PCT/EP2008/000786
§ 371 (c)(1),
(2), (4) Date: Mar. 25, 2010

(87) PCT Pub. No.: WO2008/113426
PCT Pub. Date: Sep. 25, 2008

(65) Prior Publication Data

US 2011/0132052 A1 Jun. 9, 2011

(30) Foreign Application Priority Data

Mar. 22, 2007 (DE) ..... 10 2007 013 739

(51) Int. Cl.
*B05D 1/18* (2006.01)

(52) U.S. Cl.
USPC ..... 72/47; 72/229; 72/240; 72/365.2; 118/63

(58) Field of Classification Search
USPC ..... 72/47, 199, 203, 240, 229, 236, 433; 250/339, 339.14; 427/423, 433; 118/63
See application file for complete search history.

(56) References Cited

U.S. PATENT DOCUMENTS

| | | | | | |
|---|---|---|---|---|---|
| 1,675,134 | A | * | 6/1928 | Roemer et al. | 428/659 |
| 3,251,710 | A | * | 5/1966 | Taylor et al. | 427/9 |
| 3,667,425 | A | * | 6/1972 | Bozeman et al. | 118/63 |
| 3,998,181 | A | * | 12/1976 | Bellen et al. | 118/665 |
| 4,390,377 | A | * | 6/1983 | Hogg | 148/518 |
| 5,174,822 | A | * | 12/1992 | Nabhan et al. | 118/33 |
| 5,463,801 | A | * | 11/1995 | Kajiwara et al. | 29/33 Q |
| 5,481,112 | A | * | 1/1996 | Marui et al. | 250/339.14 |
| 6,209,620 | B1 | * | 4/2001 | Pleschiutschnigg | 164/461 |
| 6,336,349 | B1 | * | 1/2002 | Hauger et al. | 72/240 |
| 6,336,350 | B1 | | 1/2002 | Klein | |

(Continued)

FOREIGN PATENT DOCUMENTS

| | | | |
|---|---|---|---|
| DE | 102004023886 | A1 | 12/2005 |
| DE | 102005031461 | A1 | 1/2007 |

(Continued)

*Primary Examiner* — Dana Ross
*Assistant Examiner* — Homer Boyer
(74) *Attorney, Agent, or Firm* — Setter Roche LLP

(57) ABSTRACT

The invention relates to a method for producing a sheet metal component. A hot or cold strip is electrolytically coated or coated in a smelting bath and the thus coated hot or cold strip is subjected to a flexible rolling process. During said process, sheet metal having various thicknesses of the flexibly rolled steel strips are produced due to various rolling pressures. Said invention is characterized in that in accordance with the thickness of the sheet metal after being rolled in a flexible manner or in accordance with the rolling pressure during flexible rolling, either the coating whilst being coated has various thicknesses, and in accordance with the rolling pressure with increasing rolling pressure that is expected, the thickness of the coating is thicker and/or the coating prior to or after the flexible rolling is subjected to a mechanical or chemical surface treatment for adjusting the desired emissivity or heat absorption capacity.

11 Claims, 2 Drawing Sheets

(56) References Cited

U.S. PATENT DOCUMENTS

| | | | | |
|---|---|---|---|---|
| 6,662,616 | B2 | 12/2003 | Bohlke et al. | |
| 6,761,935 | B2 * | 7/2004 | Sanchez et al. | 427/431 |
| 6,779,373 | B2 * | 8/2004 | Barten et al. | 72/7.6 |
| 7,004,004 | B2 * | 2/2006 | Arns et al. | 72/342.1 |
| 7,137,201 | B2 * | 11/2006 | Brodt et al. | 29/897.2 |
| 7,832,242 | B2 * | 11/2010 | Brandstatter et al. | 72/47 |

FOREIGN PATENT DOCUMENTS

| | | | |
|---|---|---|---|
| EP | 1074317 | A2 | 2/2001 |
| EP | 1080800 | A2 | 3/2001 |
| EP | 1181991 | A2 | 2/2002 |
| WO | 2006097237 | A1 | 9/2006 |

* cited by examiner

METHOD FOR FLEXIBLY ROLLING COATED STEEL STRIPS

FIELD OF THE INVENTION

The invention relates to a method for flexibly rolling coated steel bands.

BACKGROUND OF THE INVENTION

DE 10 2004 023 886 A1 has disclosed a method and device for refining flexibly rolled band material. In the manufacture of flexibly rolled band material, the material thickness of the band is periodically changed in order to produce the starting material for individual sheet bars in a continuous process, which material has material thicknesses adapted as required to the sheet metal components to be manufactured from it. After successful rolling, the band material is first wound into a coil. A heat treatment generally takes place in the wound coil. Then, the band is unwound from the coil again, subjected to a surface treatment, and wound back into a coil. Only after this, in another procedure, are individual sheet bars cut from it and processed into individual sheet metal components. Since this procedure is complex and the surface treatment is not optimal due to the different material thicknesses of the band material, the object of DE 10 2004 023 886 A1 is to provide an improved method and a device adapted to it with which it is possible to simplify and improve the refining of the flexibly rolled band material. The intent is to attain this object by virtue of the fact that the band is manufactured as a flexibly rolled band material, is wound into a coil, unwound from it again, and then heat-treated and hot-dip galvanized in a uniform, continuous passage through a treatment line composed of an annealing section, a quenching unit, a preheating unit, and a zinc bath. To this end, a continuous furnace with an annealing section, a quenching section, a preheating unit, and a zinc bath is provided, along with a blast nozzle at the end. The galvanization occurs at 470° to 500° C., with the intent being for part of the energy used for the preceding heat treatment to be also used for the galvanization procedure. Optionally, in a blast unit downstream of the zinc bath, excess adhering zinc is blasted from the band material in order to achieve a precisely set coating thickness; the band thickness is likewise determined and used to control the spacing of the nozzle.

DE 10 2005 031 461 A1 has disclosed a method for manufacturing a micro-alloyed cold band with a property profile that is matched to the thickness progression; a hot steel band with an essentially homogeneous thickness and strength is rolled to form a cold band with an essentially constant band thickness using roll-down gradients in the range between 5 and 60%, an annealing treatment of the cold band is carried out at a temperature between 500° and 600° C., and a second rolling of the cold band is carried out in which the rolling is executed flexibly so that predefined thickness progressions are set, with a region of greater thickness and a region of lesser thickness, and finally, a second annealing treatment is carried out.

EP 1 074 317 B1 has disclosed a method for flexibly rolling a metal band in which during the rolling process, the metal band is conveyed through a rolling nip between two working rollers and during the rolling process, the rolling nip is intentionally moved in order to produce different band thicknesses over the length of the metal band. This flexible rolling is characterized in that during the rolling process, the rolling nip is intentionally moved, resulting in different-length band sections being rolled with different band thicknesses that can be connected to one another via different slopes. The goal of the flexible rolling is to manufacture rolled products with cross-sectional forms that are optimized in terms of load and weight. EP 1 074 317 B1 proposes an improved process guidance for flexible rolling in order to produce a metal band with an improved flatness even in wide bands.

EP 1 080 800 B1 has likewise disclosed a method for flexible rolling that corresponds essentially to the above-mentioned method; a temperature influence acting on the metal band is compensated for during the rolling in order to avoid deviations from the desired thickness and/or desired length of the individual band sections with a predetermined final temperature of the metal band.

EP 1 181 991 A2 has also disclosed a method and a device for the flexible rolling of a metal band to enable simple production of an asymmetrical band thickness profile.

The object of the present invention is to produce flexibly rolled, corrosion-protected sheets for the press hardening method, which are significantly easier to manufacture than before.

SUMMARY OF THE INVENTION

As is already known from the prior part, during flexible rolling, different rolling pressures are used in order to manufacture different thicknesses of the steel band. Before now, no galvanized or otherwise-coated sheet metals were used for this because the flexible rolling also affects the layer thickness of the coating. The invention is also based on the problem that different sheet thicknesses result after the flexible rolling in the subsequent heating process, particularly for the press hardening, in which a heated bar sheet is inserted into a hot-forming die and formed in it or a component is formed, then heated, and form hardened in a forming die, different heating curves are produced for the different sheet thicknesses. This is problematic because the different heating curves also give rise to different temperatures, consequently causing the material properties to vary in accordance with the sheet thickness.

The coatings with which the bands to be flexibly rolled can be coated according to the invention are hot-dip coatings and electrolytic coatings, for example. Possible hot-dip coatings include hot-dip galvanic coatings, hot-dip aluminum coatings, or also mixtures thereof, i.e. alloys of zinc and aluminum, but also alloys of zinc and other metals or of aluminum and other metals.

Possible electrolytic coatings include electrolytically applied zinc coatings, for example, but it is naturally also possible to use other electrolytically applied metal coatings.

Whenever zinc coatings or hot-dip galvanic coatings are mentioned below, this is merely an illustrative example intended to also represent the other possible coatings mentioned above.

The problems recognized according to the invention, i.e. that the different sheet thicknesses produce different heating curves over the length of the band and that different zinc coating thicknesses arise as a result of the flexible rolling process, are solved according to the invention in that a hot band is hot-dip galvanized before the flexible rolling and/or the emissivity or absorption coefficient is influenced by mechanical or chemical treatment of the zinc surface. This adjustment of the emissivity/absorption coefficient makes it possible to achieve a different thermal absorption capacity over the band length. For example, the absorption coefficient is set to be poor in a region in which the band and/or the coating is particularly thin while it is set to be particularly good in the region in which the band and/or the coating is particularly thick. Naturally, corresponding intermediate steps are maintained.

In order to compensate for different zinc coating thicknesses resulting from the flexible rolling process so that after the flexible rolling, all sheet metal parts are covered with a uniform-thickness zinc coating and thus also have uniform corrosion protection properties, during the hot-dip galvanization of the hot band, the zinc coating thickness is preset through variable adjustment of the stripping pressure or of additional electromagnetic fields. Regions that will subsequently be flexibly rolled to be very thin consequently have a thicker zinc coating after the hot-dip galvanization, while regions that will remain thicker have a thinner zinc coating. Naturally, the corresponding different intermediate regions are adjusted or easily adjustable in this case as well.

The method according to the invention permits a significantly more cost-efficient manufacture of flexibly rolled sheet metal automotive parts since the costs of transporting the coils to the subsequent galvanization and the bell annealing that is customary in the prior art are eliminated. Furthermore, in lieu of a by-the-piece galvanization or a narrow-band galvanization using the Wuppermann method (WM-HDG, see FIG. 2), the significantly less expensive continuous hot-dip galvanization process can be used on the band, thus yielding significant savings here, too.

An example of the invention will be explained below in conjunction with the drawings.

DETAILED DESCRIPTION OF THE PREFERRED EMBODIMENTS

Figure 1:
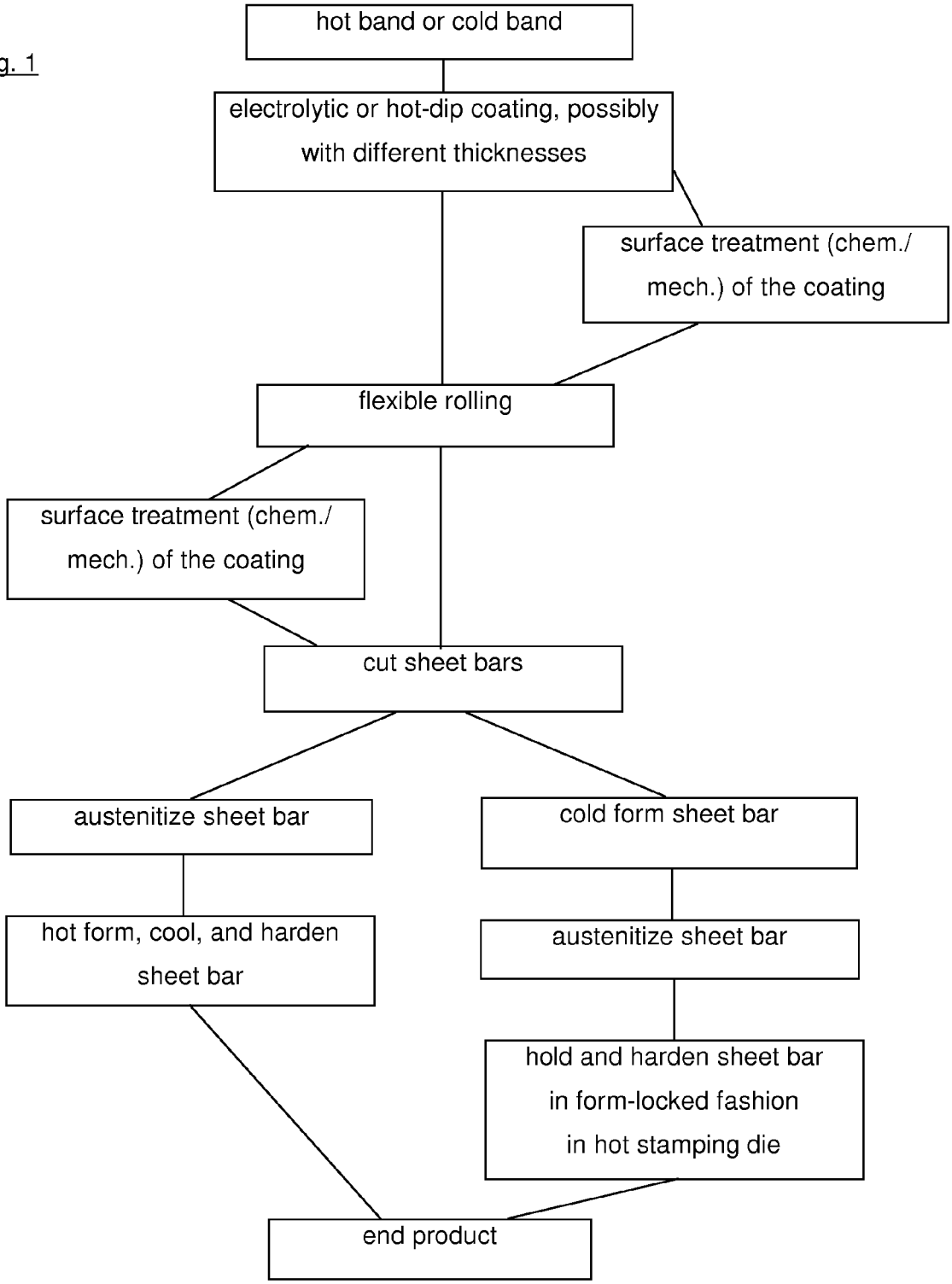
FIG. 1 is a flowchart schematically depicting the possible process sequences according to the invention.
Figure 2:
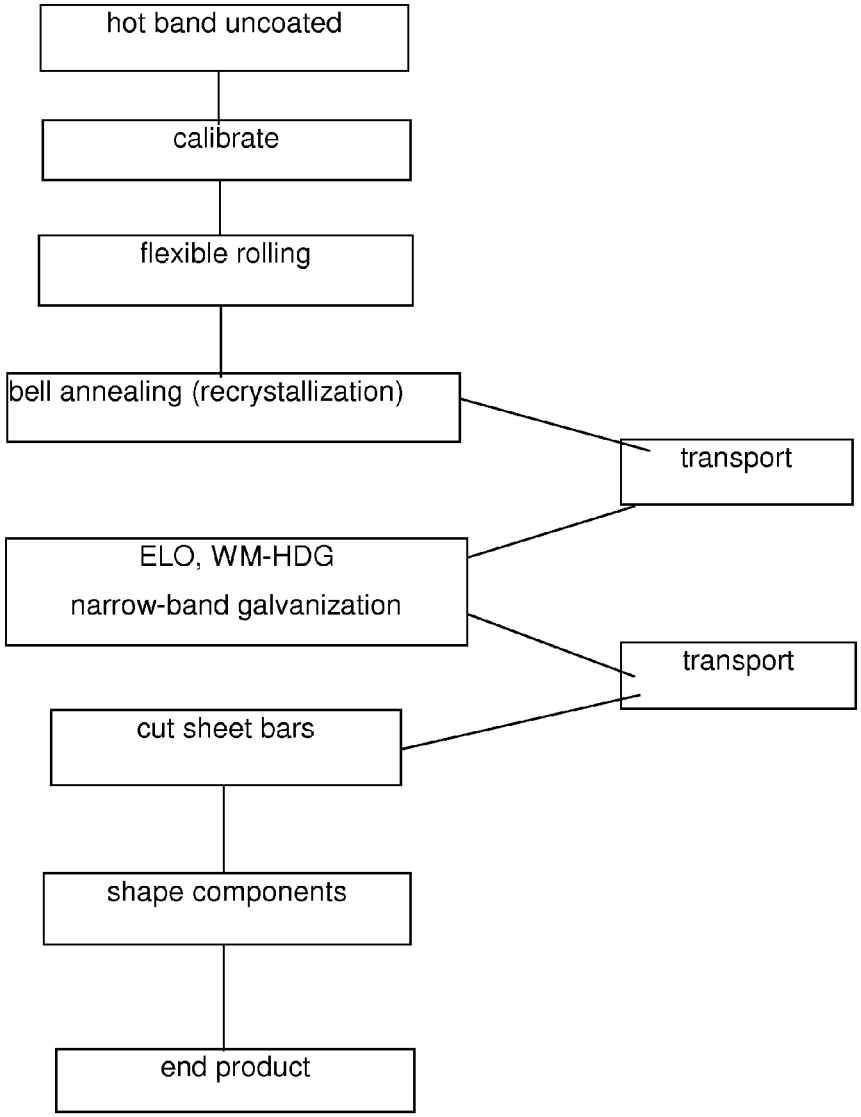
Fig. 2 Prior art
FIG. 2 is a flowchart schematically depicting the process sequence according to the prior art.

In the prior art, uncoated hot band usually composed of normal automotive steels was calibrated, flexibly rolled, and then subjected to a recrystallization annealing in order to cancel out the structural changes produced by the rolling. This recrystallization annealing usually takes place in a bell annealing furnace, with the band first being wound into a so-called coil and then annealed as an entire coil. Then these annealed coils are transported to a galvanization unit in which they are galvanized, then transported back again, sheet bars are cut from them, and components are shaped, which then yield the end product.

According to the invention, a hot band or cold band is conveyed to a hot-dip galvanization unit in which the band is unwound from the coil, welded to the preceding band, and then conveyed through the galvanization unit. In the galvanization unit, the band is heated and then conveyed through the hot-dip galvanization bath in the known way.

It is intrinsically known to provide so-called stripping nozzles, which are situated after the hot-dip galvanization bath and serve to adjust the zinc coating on the freshly galvanized band; air or another gas is blown through a wide-slot nozzle against the still-fluid zinc coating so that a pressure is exerted on the zinc coating, which pushes the fluid zinc in the direction opposite from the direction of travel of the band, yielding a predetermined coating thickness after the coating nozzle. Then the band is optionally subjected to a heat treatment and cooling.

According to the invention, the stripping device produces a zinc coating with a thickness to be flexibly applied. The stripping device can also be a unit that exerts a stripping action on the zinc coating by means of an electromagnetic field.

With a given length of the band that is conveyed through the galvanization, it is known in advance which band lengths are to be rolled thin and which band lengths are to be rolled thicker in the subsequent flexible rolling. Since the rollers that subsequently perform the flexible rolling are also controlled in accordance with the length of the band and at all times, it is known which precise band section or which precise band length of the precise coil is currently passing through the rollers, the same control is used to change the stripping nozzle pressure. Consequently, in different regions of the band, it is also possible to assure the production of different coating thicknesses of the galvanization. For example, in a region that will subsequently be rolled with particularly high intensity, i.e. will be rolled thin, the nozzle pressure is selected to be lower and therefore strips off less material than in regions in which a lower rolling intensity will be used. This operating method makes it possible, when there are different band thicknesses, to achieve a uniform zinc coating thickness over the entire band to be flexibly rolled at a later time.

The above-mentioned hot-dip galvanization method can naturally also be successfully used in the same way with other hot-dip galvanizations such as hot-dip aluminum coatings or hot-dip coatings composed of aluminum-based alloys, zinc-based alloys, and alloys of other metals or with more metals than just zinc and aluminum.

With electrolytic coatings, the coating thickness to be applied is controlled by means of the intensity of the electrolytically effective current and/or the band speed in the electrolytic coating bath, it being likewise essentially possible to use the same control here as the control with which the precisely positioned deviation of the different sheet thicknesses is carried out during the flexible rolling.

The coating, e.g. the galvanization, can be followed by the flexible rolling; as explained above, during the flexible rolling, different sheet thicknesses can be produced, which are positioned precisely in relation to the band length. Then the flexibly rolled sheet is cut in an intrinsically known fashion into sheet bars, which correspondingly also have the predetermined thickness progression over the length and width. These sheet bars with different thickness profiles are then used according to the invention for a press hardening.

The press hardening in this case can be implemented by means of two different methods.

In a first possible method, the cut sheet bars are austenitized, i.e. subjected to a heat treatment in which an austenite conversion occurs as a function of the steel used. Then the hot sheet bar is inserted into a hot-forming die and in the hot-forming die, is formed into the component and simultaneously cooled. The cooling in this case occurs at a temperature above the critical hardening temperature so that the hardening also takes place simultaneously in the forming die. Then the hardened, formed sheet bar exits the press and can optionally be further processed or is already the end product.

In a second embodiment, in lieu of a hot forming, a form hardening is carried out. In form hardening, the sheet bar is cold formed. Preferably, this cold forming has already occurred in all three spatial directions, as well as the cutting of the edges and the production of a pattern of holes. Preferably, the sheet bar is removed from the die undersized by 0.5 to 2% in all three spatial directions and is then austenitized. In the austenitization, the thermal expansion compensates for the undersizing of 0.5 to 2% so that after the planned heating is completed, the shaped sheet bar has its final geometry. This sheet bar, which now corresponds to the final geometry or final contour, is inserted into a form hardening die, which likewise has precisely the contour and geometry of the desired end component. In the form hardening die, the component is held in a form-locked way—at least in the regions that are subjected to particularly intense forming, preferably being held in a form-locked way in its entirety—and hardened by the cooling.

Then the component is removed as an end product from the form hardening die.

As has already been explained, an austenitization of the sheet bars takes place. In this case, with the preferably used hardenable steels of the 22MnB5 type, the sheet bar is heated to approximately 900° to 950° C. Because the sheet bar has different sheet thicknesses, there are also different heat progressions and heat treatment profiles in the sheet, which in the final analysis result in different temperatures over the length and width of the sheet bar. Since the goal is to achieve a complete hardening, the regions with greater sheet metal thicknesses must also reach at least the austenitizing temperature. However, this results in an overheating, so to speak, of the thinner regions. Because of these differing temperature and heat-treatment profiles of the different sheet metal thickness regions of the sheet bar, different hardnesses and material properties can occur over the course of the entire treatment process.

In order to prevent this or reduce its occurrence, after the galvanization and before the flexible rolling or after the flexible rolling and before the sheet bars are cut to size, influence is exerted on the surface of the band.

The surface treatment of the band can occur in different ways. The goal of the surface treatment is to influence the emissivity, the absorption of heat, or thermal radiation. This also makes it possible to avoid applying different zinc coating thicknesses before the rolling and to use only the surface treatment to achieve virtually identical properties when annealing.

According to the invention, this can occur through a matting treatment, a skin pass rolling, i.e. a micro-contouring of the surface, or an additional coating.

It is therefore possible for the regions—which will be rolled with particular intensity during the flexible rolling and will subsequently constitute thinner regions of the band—to be embodied as particularly reflective or emissive in order to absorb as little heat as possible during the heating for the austenitization.

The regions, which will be thicker at a later point than the flexible rolling or will already be thicker after the flexible rolling itself, can be given a matte, not very reflective or skin-pass-rolled surface or can be provided with a temporary, dark protective lacquer or with a metal oxide surface, which permits a particularly good absorption of thermal radiation and therefore a good soaking of the thicker regions.

For the surface treatment, essentially the same control as the one for the flexible rolling or flexible galvanization is used, so that the surface finish of the corresponding regions can be changed in a precisely positioned and very correct fashion.

One advantage of the invention is that it succeeds in producing hardenable steels—which must be subjected to a heat treatment for the hardening, are flexibly rolled, and nevertheless have a corrosion-protection coating—thus achieving products with a high degree of homogeneity with regard to material properties.

In addition, this method is able to produce sheet metal components in a significantly more advantageous fashion.

The invention is not limited to hardenable steels, for example of the 22MnB5 type. The flexible galvanization or the galvanization with flexible coating thicknesses can also be successfully used in steels not intended to undergo any further heat treatment.

In steels, which are to be subjected to an annealing after the flexible rolling in order to reinstate original material properties, it is also possible for the flexibly rolled steels with the flexible galvanization according to the invention to be conveyed through a continuous annealing; the differently set emissivities of the surfaces achieve a very exact, homogeneous distribution of material properties in continuous annealing as well.

The invention claimed is:

1. A method for manufacturing a sheet metal component, comprising:

hot-dipping or electrolytically coating a hot or cold band;

subjecting the thus-coated hot or cold band to a flexible rolling process in which different roller pressures are used to produce different sheet thicknesses of the flexibly rolled steel band; and matching to the sheet thickness after the flexible rolling or matching to the roller pressure during the flexible rolling, either by embodying the coating with different thicknesses during the coating procedure—where depending on the roller pressure, the coating thickness is embodied as thicker as the expected roller pressure increases—and/or before or after the flexible rolling, by subjecting the coating to a mechanical or chemical surface treatment in order to adjust a desired emissivity or thermal absorption capacity.

2. The method as recited in claim 1, comprising adjusting the coating thickness by adjusting the intensity of the pressure of the gas flow in stripping nozzles of a hot-dip coating unit.

3. The method as recited in claim 1, comprising adjusting the coating thickness by changing the electrolytically effective current intensity and/or the band speed in the electrolysis bath.

4. The method as recited in claim 1, comprising adjusting the coating thickness by using an electromagnetic method or additionally by using an electromagnetic method.

5. The method as recited in claim 1, comprising coating or skin-pass-rolling the surface so that it is matte, reflective, or colored.

6. The method as recited in claim 1, comprising using a control that is required to carry out the flexible rolling in a precisely positioned fashion on the band in order to control the coating thickness on the band and/or to control the surface treatment.

7. The method as recited in claim 1, comprising using a hardenable steel for the steel material.

8. The method as recited in claim 1, comprising using a steel of the 22MnB5 type.

9. The method as recited in claim 1, comprising cutting the flexibly rolled steel material, which is embodied with coating thicknesses and/or surface treatments that depend on the steel material thickness, into sheet bars, austenitizing the sheet bars, hot-forming the austenitized hot sheet bars, cooling the sheet bars in the hot-forming die, and allowing the sheet bars to harden by cooling the sheet bars.

10. The method as recited in claim 1, comprising cutting the flexibly rolled steel band, which is embodied with a coating matched to the sheet thickness and is optionally provided with a surface treatment, into sheet bars, cold forming the sheet bars, austenitizing the cold-formed sheet bars, and inserting the austenitized, cold-formed sheet bars into a form hardening die, which form hardening die essentially corresponds to the contour or geometry of an end component, and subjecting at least at least one region of the sheet bars to intense forming by holding the cold-formed sheet bar in a form-locked way, and cooling and hardening the sheet bar in a form hardening die.

11. The method as recited in claim 1, wherein the hot-dip or electrolytic coating is selected from the group consisting of a hot-dip coating composed of zinc or based on zinc, a hot-dip coating composed of aluminum or based on aluminum, and an electrolytic coating composed of zinc or based on zinc.

* * * * *